US010227850B2

(12) United States Patent
Agrawal et al.

(10) Patent No.: US 10,227,850 B2
(45) Date of Patent: Mar. 12, 2019

(54) FLOW CONTROL DEVICES INCLUDING MATERIALS CONTAINING HYDROPHILIC SURFACES AND RELATED METHODS

(71) Applicant: Baker Hughes Incorporated, Houston, TX (US)

(72) Inventors: Devesh K. Agrawal, Houston, TX (US); Anil K. Sadana, Houston, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 808 days.

(21) Appl. No.: 14/302,099

(22) Filed: Jun. 11, 2014

(65) Prior Publication Data

US 2015/0361773 A1 Dec. 17, 2015

(51) Int. Cl.

| | |
|---|---|
| ***E21B 43/08*** | (2006.01) |
| ***E21B 43/12*** | (2006.01) |
| ***E21B 37/06*** | (2006.01) |
| ***E21B 37/08*** | (2006.01) |
| ***E21B 41/02*** | (2006.01) |

(52) U.S. Cl.

CPC ..... *E21B 43/082* (2013.01); *E21B 37/06* (2013.01); *E21B 37/08* (2013.01); *E21B 41/02* (2013.01); *E21B 43/12* (2013.01)

(58) Field of Classification Search

CPC ..... E21B 43/082; E21B 41/02; E21B 37/06; E21B 43/12; E21B 37/08

See application file for complete search history.

(56) References Cited

U.S. PATENT DOCUMENTS

| | | | | |
|---|---|---|---|---|
| 2,391,609 A * | 12/1945 | Wright | E21B 43/082 166/228 |
| 3,083,766 A | 4/1963 | Graham et al. | |
| 4,241,787 A | 12/1980 | Price | |
| 4,497,714 A | 2/1985 | Harris | |
| 4,592,849 A | 6/1986 | McMillen | |
| 4,917,183 A * | 4/1990 | Gaidry | E21B 43/082 166/228 |
| 5,050,678 A * | 9/1991 | Gaidry | E21B 43/082 166/228 |
| 5,309,994 A * | 5/1994 | Douglas | E21B 43/082 166/228 |

(Continued)

FOREIGN PATENT DOCUMENTS

WO 2013095419 A1 6/2013

OTHER PUBLICATIONS

International Search Report for International Application No. PCT/US2015/035318 dated Aug. 25, 2015, 4 pages.

(Continued)

*Primary Examiner* — Blake E Michener
(74) *Attorney, Agent, or Firm* — TraskBritt

(57) ABSTRACT

Flow control devices for regulating fluid flow from a subterranean formation by utilizing materials containing hydrophilic surfaces in a flow path of formation fluids. The flow control device comprises a tubular body, a flow path, and a material having a hydrophilic surface disposed within the flow path to restrict the flow of water. Methods of making and systems utilizing the flow control devices are disclosed.

18 Claims, 4 Drawing Sheets

(56) References Cited

U.S. PATENT DOCUMENTS 5,339,895 A * 8/1994 Arterbury ..... B01D 29/111 166/227
5,597,493 A 1/1997 Torini
5,896,928 A 4/1999 Coon
6,109,350 A 8/2000 Nguyen et al.
6,164,380 A 12/2000 Davis
6,372,135 B1 * 4/2002 Kohlstadt ..... B01D 39/2079 210/497.01
6,395,184 B1 * 5/2002 Bukhtiyarov ..... B01D 17/10 210/266
7,395,858 B2 7/2008 Barbosa et al.
7,913,765 B2 3/2011 Crow et al.
7,918,272 B2 4/2011 Gaudette et al.
7,918,275 B2 4/2011 Clem
7,942,206 B2 5/2011 Huang et al.
8,096,351 B2 1/2012 Peterson et al.
8,443,888 B2 5/2013 Coronado
8,544,548 B2 10/2013 Coronado et al.
8,616,272 B2 12/2013 Mazyar et al.
2007/0012444 A1 1/2007 Horgan et al.
2008/0283238 A1 11/2008 Richards et al.
2009/0133869 A1 5/2009 Clem
2009/0236102 A1 9/2009 Guest et al.
2009/0301726 A1 12/2009 Coronado
2010/0051270 A1 * 3/2010 Dusterhoft ..... E21B 43/082 166/278
2011/0036578 A1 2/2011 Coronado
2011/0308806 A9 12/2011 Dykstra et al.
2013/0048081 A1 2/2013 Agrawal et al.
2013/0048129 A1 2/2013 Sadana et al.
2013/0126184 A1 5/2013 Gerrard et al.
2013/0206393 A1 * 8/2013 Kuo ..... E21B 43/082 166/227
2013/0220633 A1 8/2013 Felten

OTHER PUBLICATIONS

International Written Opinion for International Application No. PCT/US2015/035318 dated Aug. 25, 2015, 9 pages.

* cited by examiner

FLOW CONTROL DEVICES INCLUDING MATERIALS CONTAINING HYDROPHILIC SURFACES AND RELATED METHODS

TECHNICAL FIELD

Embodiments of the present disclosure relate generally to flow control devices, methods, and systems for selectively regulating flow of production fluids from a subterranean formation within a wellbore.

BACKGROUND

Downhole completion systems are often used to produce or harvest hydrocarbon materials (e.g., crude oil, natural gas, etc.) from subterranean formations. Often, the hydrocarbon materials are recovered from multiple formations (or production zones) along the wellbore. Undesirable fluids (e.g., water, brine, etc.) are often present in the production zones along with the hydrocarbon materials. Generally, it is desirable to produce only hydrocarbons from a well and leave the undesirable fluids within the well. As a result, inflow control devices (often referred to as "ICDs") are used to limit production of water in order to maximize the yield of hydrocarbons.

Generally, current ICDs are complex, expensive, and only partially reduce the flow of water. Additionally, many of the current devices are mechanically activated and thus require manual intervention. For example, in some approaches, valves may be used to select between hydrocarbons and water based on relative viscosity of the fluids. The valve may include a switching mechanism including, for example, a vortex assembly used to select a fluid based on viscosity. The valve may then direct the water through a tortuous pathway to restrict the flow rate. In other examples, ICDs may be configured to limit or reduce the flow of water by using filters, restricted openings, indirect flow paths, etc. In yet other examples, devices may include expandable materials (e.g., cross-linked gels, cement compositions, polymers, etc.) placed in flow passageways. The hydrocarbons are allowed to flow though the passageways unimpeded while water is restricted due to expansion of the expandable or swellable materials.

However, in many cases, reduction in the flow of water may be limited or may also result in a reduction in the flow of hydrocarbons. As a consequence, the capacity to drain the reservoir efficiently while maximizing production and recovery is diminished. In addition, while mechanically activated devices may be adjusted at the wellsite before deployment, changing ratings during the lifespan of the well can be difficult, if not impossible. The effectiveness of ICDs is largely determined by the ability to optimize performance during production.

BRIEF SUMMARY

Embodiments disclosed herein include a flow control device for regulating fluid flow from a subterranean formation, comprising, at least one tubular body having an interior surface, an exterior surface and at least one aperture extending through the at least one tubular body between the exterior surface and the interior surface, at least one flow path extending from the exterior surface through the at least one aperture and longitudinally through the at least one tubular body and a material disposed in communication with the at least one flow path, the material having a hydrophilic surface located and configured to contact formation fluids flowing along the at least one flow path.

In additional embodiments, a method for making a flow control device to regulate fluid flow from a subterranean formation comprises providing at least one tubular body having an interior surface, an exterior surface, and at least one flow path comprising at least one aperture extending between the exterior surface and the interior surface, and disposing a material having a hydrophilic surface in communication with the at least one flow path.

In further embodiments, a system for controlling flow of a fluid from a subterranean formation comprises at least one wellbore tubular, at least one tubular body positioned adjacent the wellbore tubular, the at least one tubular body having an interior surface, an exterior surface, and at least one aperture extending between the exterior surface and the interior surface, the at least one tubular body defining at least one flow path extending through the at least one aperture and longitudinally through the at least one tubular body, and a material disposed in communication with the at least one flow path, the material comprising at least a hydrophilic surface located and configured to contact formation fluids flowing along the at least one flow path.

BRIEF DESCRIPTION OF THE DRAWINGS

While the specification concludes with claims particularly pointing out and distinctly claiming what are regarded as embodiments of the invention, the advantages of embodiments of the disclosure may be more readily ascertained from the following description of certain embodiments of the disclosure when read in conjunction with the accompanying drawings, in which:

DETAILED DESCRIPTION

Illustrations presented herein are, in some cases, not meant to be actual views of any particular material, component, or system, but are merely idealized representations that are employed to describe embodiments of the present disclosure. Elements common between figures may retain the same numerical designation.

The following description provides specific details, such as types and placement of materials, in order to provide a thorough description of embodiments of the disclosure.

However, a person of ordinary skill in the art will understand that the embodiments of the disclosure may be practiced without employing these specific details. Indeed, the embodiments of the disclosure may be practiced in conjunction with conventional techniques employed in the industry. Only those process acts and structures necessary to understand the embodiments of the disclosure are described in detail below. Additional acts or materials for controlling fluid flow from a subterranean formation may be performed by conventional techniques.

Figure 1:
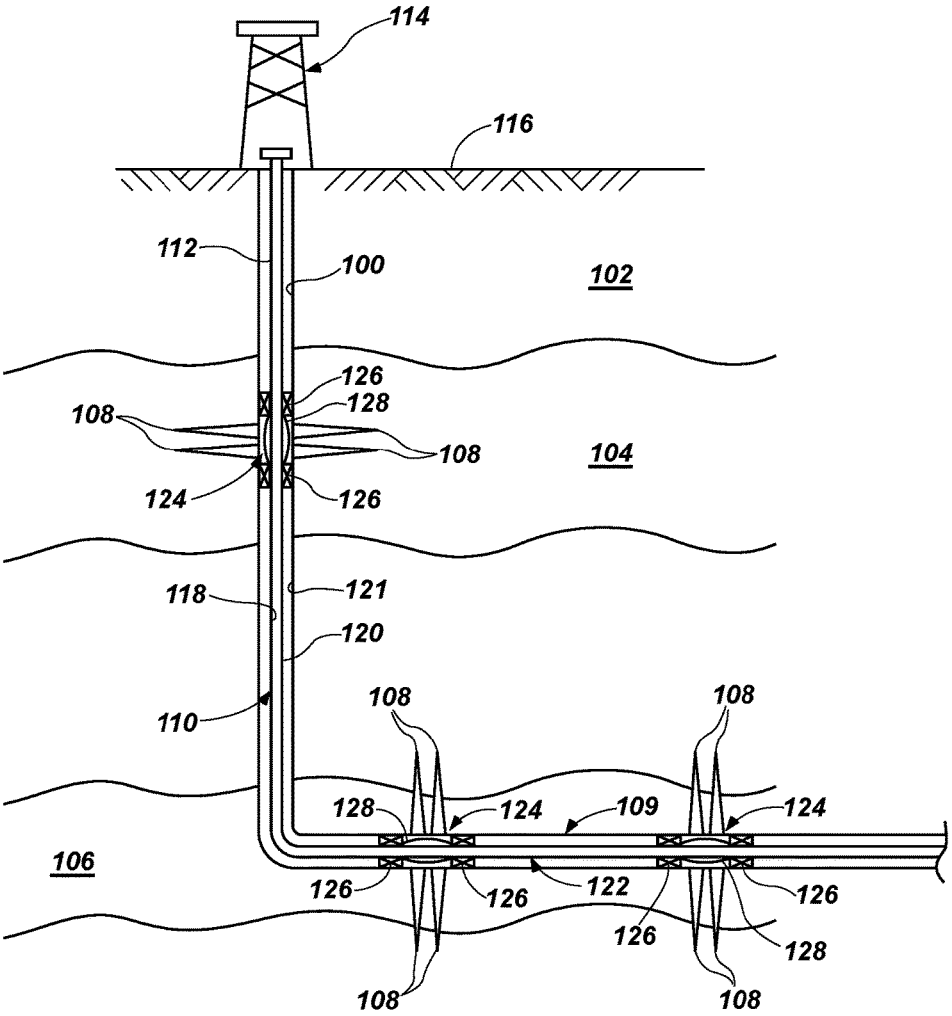
FIG. 1 is a schematic elevation view of a multi-zonal wellbore and production assembly incorporating an inflow control system as described herein.

Referring to FIG. 1, a wellbore 100 is shown. The wellbore 100 may be drilled through the earth 102 and into one or more formations 104 and 106, commonly termed "producing formations," from which hydrocarbon production is desired. The wellbore 100 may be cased or lined by a tubular metal string, as is known in the art, and a number of perforations 108 penetrate the string and extend into the producing formations 104 and 106 so that production fluids may flow from the producing formations 104 and 106 into the wellbore 100. In some embodiments, the wellbore 100 may have a deviated leg 109 as shown in FIG. 1, which may be substantially horizontal, or otherwise deviate from the vertical. The wellbore 100 may include a production assembly 110 in communication with an upper portion of production string 112 that extends downwardly from a wellhead 114 at a surface 116 of the wellbore 100. The production assembly 110 defines an internal axial flowbore 118 along its length in communication with the wellhead through the upper portion of production string 112. An annulus 120 is defined between the production assembly 110 and a wellbore inner surface 121. The production assembly 110 is shown to have a horizontal portion 122 extending along the deviated leg 109 of the wellbore 100. Production devices 124 according to embodiments discussed herein, may be positioned at selected locations along the production assembly 110. In some embodiments, each production device 124 may be isolated from other, non-hydrocarbon producing portions of the wellbore 100 by a pair of flanking packer devices 126. Although only three production devices 124 are shown in FIG. 1, one associated with producing formation 104 and two with producing formation 106, there may be any number of such production devices 124 arranged in serial fashion to maximize hydrocarbon production.

Production fluids flow directly from the producing formations 104 and 106 into the annulus 120 defined between the production assembly 110 and a wall of the wellbore 100. Each production device 124 may include a production control device 128 that is used to govern one or more aspects of fluid flow into the production assembly 110. In accordance with the present disclosure, the production control device 128 may have any of a number of alternative constructions that ensure selective controlled fluid flow therethrough.

Figure 2A:
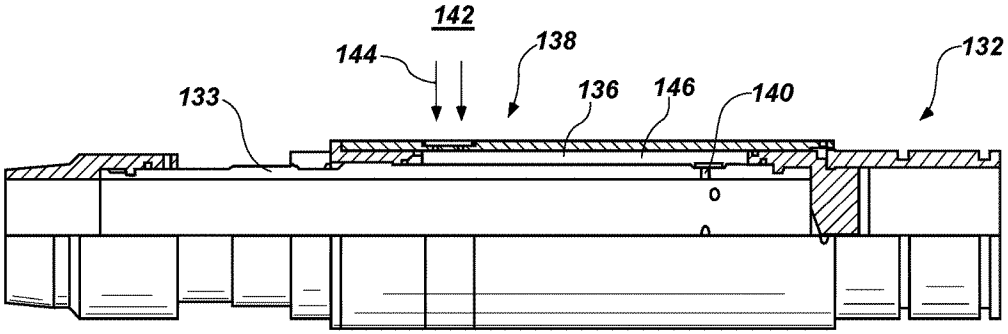
FIG. 2A is a three-quarter-sectional view of a flow control device as described herein.

Referring now to FIG. 2A, a flow control device 132 is shown. The flow control device 132 may include an inner tubular body 133. The inner tubular body 133 may be, for example, a base pipe in the form of a tubular sub, or other member of the production string 112 (as shown in FIG. 1). The flow control device 132 may define at least one flow path 136 to an interior thereof. In some embodiments, the flow path 136 may be defined by an internal channel or annular cavity extending longitudinally between an inlet 138 and one or more outlets 140. The inlet 138 may be in fluid communication with a subterranean reservoir, formation, which may also be characterized as a production zone 142, for receiving a formation fluid 144. The outlet 140 may be in fluid communication with an interior of the inner tubular body 133 for directing the formation fluid 144 into the inner tubular body 133. Generally, the flow path 136 is in communication with any pathway leading from the production zone 142 to the surface 116 (as shown in FIG. 1). Specifically, the flow control device 132 is configured to contain and define the flow path 136 from the inlet 138, through any pathway (e.g., internal channel, annular cavity, etc.) leading through the outlet 140, or similar such opening or aperture, and into the interior of inner tubular body 133.

The formation fluid 144 may include, for example, hydrocarbons (e.g., oil), or some other desirable component of a fluid mixture, the production of which is intended. As used herein, the term "fluid" or "fluids" means and includes liquids, gases, hydrocarbons, multi-phase fluids, as well mixtures, suspensions and emulsions of two or more fluids, water, brine, and fluids injected from the surface, such as water or drilling mud. Additionally, references to water should be construed to also include water-based fluids (e.g., brine or salt water). Subsurface formations typically contain water, brine, or other undesirable fluids along with hydrocarbons or other desirable fluids. For the sake of discussion "water" may be used to generally represent any undesirable fluid, while "hydrocarbons," "oil," or "natural gas" may be used to generally represent any desirable fluid, although other fluids may be desirable or undesirable in other embodiments.

The flow control device 132 may be used generally to regulate the flow of the formation fluid 144 from the production zone 142 into the inner tubular body 133. At least one flow control device 132 may be orientated either vertically or horizontally. Often, water will begin to flow into the flow control device 132 after the formation fluid 144 has been drawn out of a reservoir or production zone 142 for a certain amount of time. The amount and timing of water inflow can vary along the length of the production zone 142 and from zone to zone. Thus, it is desirable to have passive devices that will restrict the flow of water in response to higher percentages of undesirable fluid flow. As used herein, the term "passive" means and includes without the manipulation of mechanical devices. For example, the flow control device 132 may regulate the inflow of fluids without human intervention, intelligent control, or an external power source. Thus, the flow control device 132 and devices according to other embodiments disclosed herein are configured to passively restrict or impede the water (or other undesirable fluid) component of formation fluid 144 in order to enable a higher percentage of the hydrocarbon (or other desirable fluid) component to be produced over the life of production zones.

Generally, flow control devices disclosed herein include a hydrophilic material at least partially disposed within the flow path 136. In some embodiments, the formation fluid 144 contacts, flows by, or flows through the hydrophilic material. For example, in the embodiment of FIG. 2A, a volume or body of material 146 may be located within the annular cavity defining the flow path 136. In other embodiments, the material 146 may be formed from a hydrophilic material arranged as a porous body, bead pack, particulate material, coating, etc., as described in more detail below. In some embodiments, the material 146 may partially or completely fill the annular cavity or similar space defining the flow path 136 within the flow control device 132. For example, the material 146 may be located between a liner, casing, or filter and the inner tubular body 133. In other embodiments, the material 146 may be a coating comprising the material 146 on partial or continuous sections of any other components of the flow control device 132, either internal or external the inner tubular body 133. In addition, channels or tubes formed by or lined with plugs made from hydrophilic materials may be disposed in orifices, ports, openings, or any other flow-transmitting features defining the flow path 136, and combinations thereof.

Similarly, a process of making the flow control device 132 may include providing at least one inner tubular body 133 having an interior surface 134, an exterior surface 135, and at least one flow path 136 comprising at least one aperture 154 extending between the exterior surface 135 and the interior surface 134, and disposing a material 146 having a hydrophilic surface in communication with the at least one flow path 136. Other embodiments may include positioning any configuration of a filter, mesh, and permeable membrane exterior to the material 146. Alternatively, other embodiments may include disposing the material 146 in communication with the flow path 136 by placing the material 146 along the interior surface 134 of the at least one inner tubular body 133. Additional configurations or processes of the flow control device 132 are disclosed in U.S. Patent Publication No. 2013/0048129, dated Feb. 28, 2013, titled METHOD AND APPARATUS FOR SELECTIVELY CONTROLLING FLUID FLOW, the entire disclosure of which is incorporated herein in its entirety by this reference.

Hydrophilic materials are those that will more effectively impede, restrict, or inhibit flow of one fluid component (i.e., water-based fluids) through the material 146 than another fluid component, based on a property of the fluids. That is, if the formation fluid 144 comprises a mixture of hydrocarbons and water, then the material 146 will comprise a material that more greatly impedes the passage of water through the flow control device 132 than the passage of hydrocarbons, which is allowed to flow relatively unimpeded. As used herein, the teen "hydrophilic" means and includes having a strong affinity for water. Further, hydrophilic refers to materials on which water spreads out, maximizing surface area contact with the material. In some embodiments, the hydrophilic materials may be high surface energy materials. For example, in the embodiment where the formation fluid 144 is a mixture of hydrocarbons and water, the material 146 may comprise a material having a surface energy higher than that of water (i.e., a surface energy density higher than about 0.072 $J/m^2$). Since the surface energy of water is higher than that of hydrocarbons, water will more readily spread out on a high surface energy material in order to minimize interfacial energy. Intermolecular forces account for the strong attractive force between water and high surface energy materials, such as glass. Hydrophilic materials may include, for example, quartz sand, flint, agate, porous glass, glass beads, and combinations thereof. In some embodiments, the materials may include, for example, titanium dioxide ($TiO_2$) doped composites and ceramic-based composites. In other embodiments, the hydrophilic materials may comprise silicon dioxide ($SiO_2$) (commonly referred to as "silica") and surface-modified silicon dioxide.

Alternatively, high surface energy materials may be described as wettable. As used herein, the term "wettable" means and includes the ability of a liquid to maintain contact with a solid surface resulting from intermolecular interactions when the two are brought together. Because of the nature of these surfaces, water and brine are wettable and hydrocarbons are nonwettable. In addition, measuring the contact angle of a water droplet in relation to the surface of a material is one way of assessing the hydrophilicity of the material. For example, the contact angle of water on a hydrophilic material is about 90° or less, while the contact angle for hydrocarbons on a material is about 90° or more. As is known, generally, a contact angle less than 90° indicates that the fluid at least partially wets the material, while a contact angle more than 90° indicates that the fluid does not wet the material. Water is known to wet silica glass nearly completely, resulting in a contact angle being virtually zero.

In addition, while many high surface energy materials with smooth, rigid, or chemically homogenous surfaces may be suitable for hydrophilic materials, rough surfaces may increase the hydrophilicity, and thus the attraction, of water to certain materials. In some embodiments, the surface may have physical structures such as hair-like, honeycomb, and sponge-like surfaces for trapping the water molecules, increasing the contact surface area, or both. In some embodiments, for example, size, shape and contour of the material may be varied to increase the hydrophilicity of the material. Furthermore, the material 146 may contain any configuration of hydrophilic materials for delaying or restricting the flow of water and may be arranged in a variety of ways as discussed below.

Figure 2B:
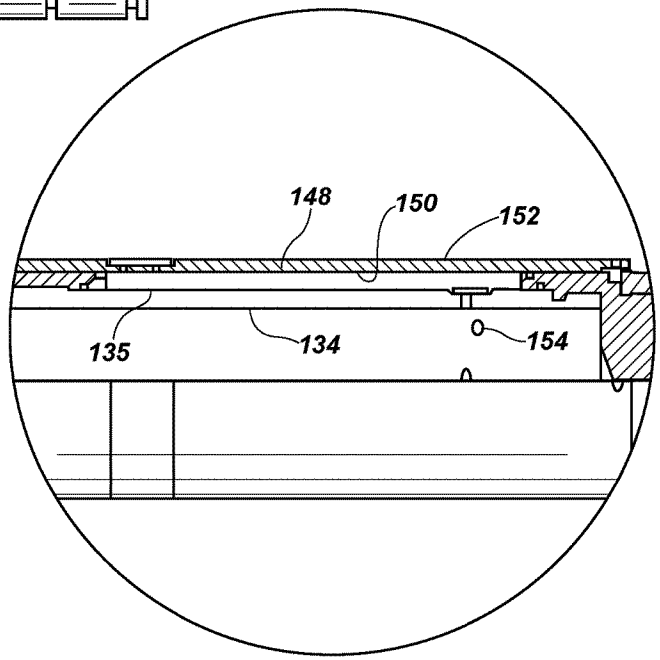
FIG. 2B is an excerpt from FIG. 2A illustrating a flow control device as described herein.

FIG. 2B is an excerpt from FIG. 2A illustrating an enlarged view of a portion of the flow control device 132. As shown in FIG. 2B, the inner tubular body 133 of FIG. 2A includes an interior surface 134 and an exterior surface 135. The flow control device 132 may also include an outer tubular body 148 having an interior surface 150 and an exterior surface 152. In some embodiments, the outer tubular body 148 may comprise a liner or casing. In other embodiments, the outer tubular body 148 may comprise any structure (e.g., screen, filter, filter assembly, etc.) configured for filtering sediment and particulates from the formation fluid 144 prior to entering the flow control device 132. In some embodiments, at least one aperture 154 may extend radially through the inner tubular body 133. The aperture 154 may be of any shape and size, or may be configured as any other component (e.g., channel, tube, orifice, port, or opening) in the inner tubular body 133.

Figure 3:
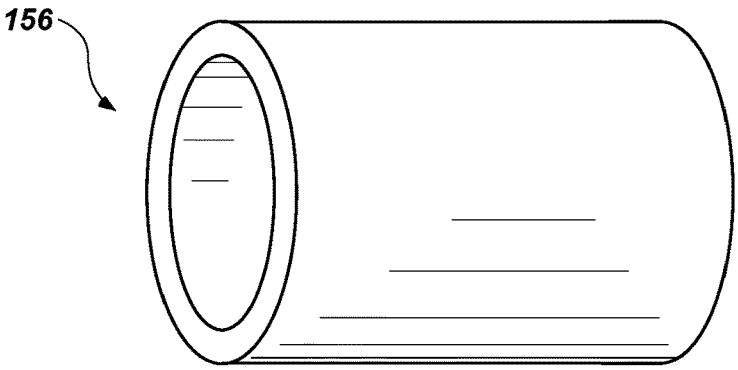
FIG. 3 is a simplified drawing illustrating an embodiment of elements foiinable from hydrophilic materials as described herein.

FIG. 3 is a simplified drawing illustrating an embodiment of the material 146 including hydrophilic materials, as discussed above in regard to FIG. 2A. As shown in FIG. 3, the material 146 may be shaped as a sleeve 156. The sleeve 156 may be positioned within the flow path 136 of the flow control device 132. In one embodiment, the sleeve 156 may be located between the inner tubular body 133 and the outer tubular body 148 (as shown in FIG. 2A). The sleeve 156 may include a porous core of hydrophilic materials, such as porous glass. Although shown as a sleeve or hollow cylinder in FIG. 3, porous cores may also take the form of rods, blocks, spheres, pellets etc., or any other desired form depending on the shape and configuration of the flow path in which the core is installed. In some embodiments, the sleeve 156 may be porous so as to allow flow through the sleeve 156, for example, either axially or radially. In addition, the porosity and permeability of the material 146 may be adjusted for specific production zones and may be the same or different for different production zones.

Figure 4:
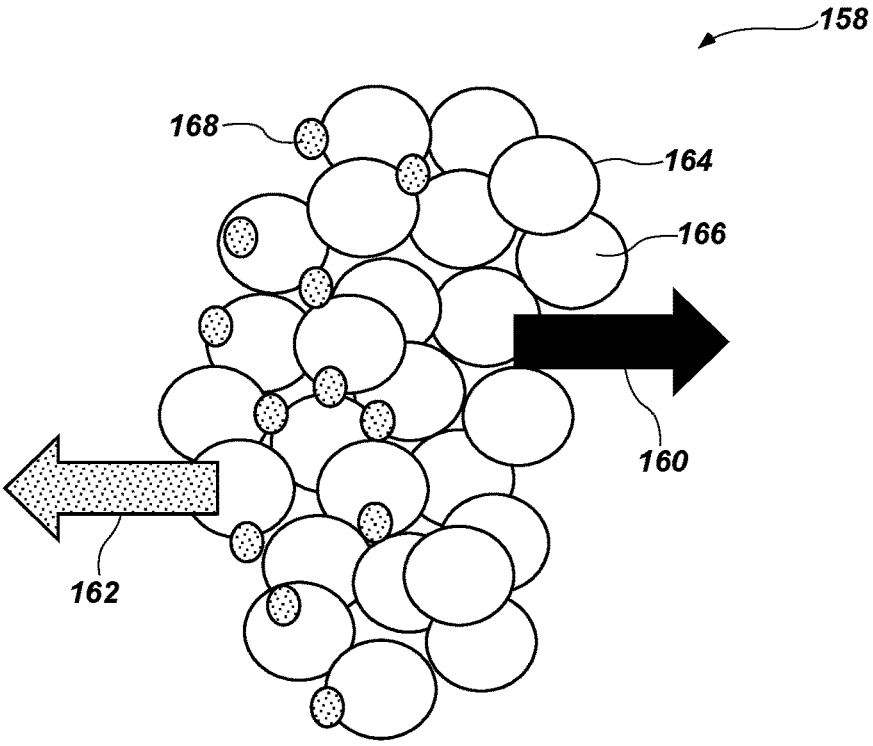
FIG. 4 is a simplified drawing illustrating an embodiment of elements formable from hydrophilic materials as described herein.

FIG. 4 is a simplified drawing illustrating an embodiment of the material 146 (as shown in FIG. 2A). A packet 158 may be one embodiment of the material 146 and may include a plurality of particles 164 (e.g., quartz sand, flint, agate, porous glass, glass beads, etc.). The particles 164 may be made from materials having a hydrophilic surface 166. In some embodiments, the hydrophilic surface 166 may be wettable, as discussed above. While, the packet 158 is illustrated as spherical particles in FIG. 4, any configuration, size, or shape, including regular or irregular, may be used in other embodiments. The packet 158 may be retained within a filter, mesh, permeable membrane, or any combination thereof, and may be positioned within the fluid control device 132 in fluid communication with formation fluids 144 flowing along the flow path 136, as discussed above in regard to FIG. 2A. Returning to FIG. 4, water droplets 168 will be attracted to and formed on the hydrophilic surface 166 as a fluid mixture flows through the material 146. This process will result in the delay of a flow of water 162 while allowing a flow of hydrocarbons 160 to continue unimpeded. In one embodiment, an initial amount of water may be used to wet the particles 164 in order to initiate the process. The initial amount of water may help facilitate and accelerate the attraction of water droplets 168 to the hydrophilic surface 166, and in so doing increase the hydrophilicity, and thus, the ability of the material to retain and delay the flow of water 162.

Figure 5:
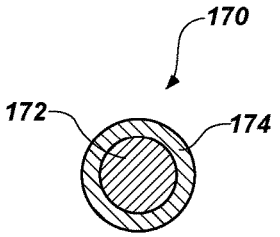
FIG. 5 is a simplified drawing illustrating an embodiment of elements formable from hydrophilic materials as described herein.

FIG. 5 is a simplified drawing illustrating an embodiment of a bead 170 having a core 172. At least one bead 170 may be positioned within the flow control device 132, for example, within the annular cavity defining the flow path 136. In one embodiment, the bead 170 may be located between the inner tubular body 133 and the outer tubular body (as shown in FIG. 2A). The core 172 may include, for example, metal, glass, ceramic, or other filler material having a coating 174. In one embodiment, the coating 174 may comprise a hydrophilic material, as discussed above. In other embodiments, the core may be made of a magnetic material and may be configured, for example, with a ferromagnetic or ferrimagnetic core configured for attraction to paramagnetic surfaces.

Figure 6:
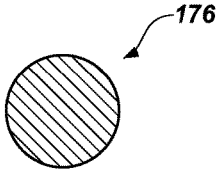
FIG. 6 is a simplified drawing illustrating an embodiment of elements formable from hydrophilic materials as described herein.

FIG. 6 is a simplified drawing illustrating an embodiment of a bead 176 having a shape of a homogenous sphere. In one embodiment, at least one bead 176 may be positioned within the annular cavity defining the flow path 136 of the flow control device 132 and may be located between the inner tubular body 133 and the outer tubular body, as discussed above in regard to FIG. 2A. In some embodiments, the bead 176 may have the shape of a ball, cylinder or other shaped body of hydrophilic material. In addition, the coating 174 (shown in FIG. 5) and the bead 176 may be porous or nonporous, with the fluids forced to flow either through or around the beads. The beads 170 and 176 could have any desired shape (e.g., spherical, cuboidal, ellipsoidal, cylindrical, regular, irregular, etc.). The beads 170 and 176 could similarly be of any desired size.

Figure 7:
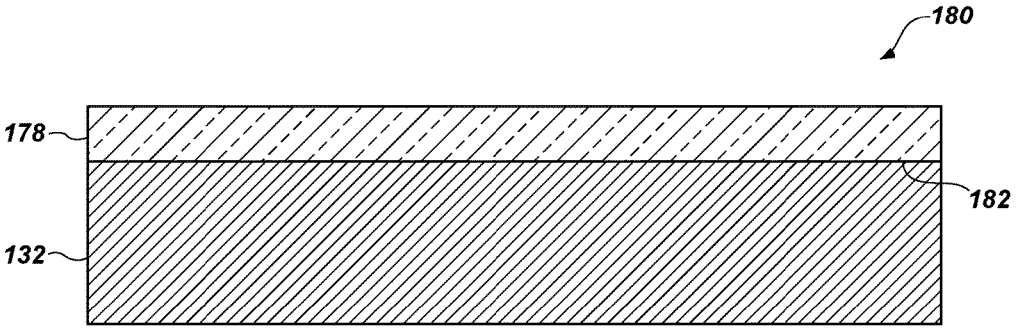
FIG. 7 is a simplified drawing illustrating an embodiment of elements formable from hydrophilic materials as described herein.

FIG. 7 is a simplified drawing illustrating an embodiment of a panel 180 of the flow control device 132. The panel 180 may include a coating 178 applied to a surface 182 of the flow control device 132 adjacent the flow path 136 (as shown in FIG. 2A) such as, for example and without limitation, an exterior surface of inner tubular body 133. In some embodiments, the coating 178 may be made of glass, as illustrated in FIG. 7, or the coating 178 may be made of any hydrophilic material, as described above. For example, titanium dioxide doped composites and ceramic-based composites as well as materials comprising silicon dioxide and surface-modified silicon dioxide may be used as the coating 178. In addition, the coating 178 may be applied to any existing device containing a known configuration, including by way of non-limiting example, a tortuous pathway. As used herein, the term "tortuous pathway" means and includes a flow path that is circuitous, winding, twisted, meandering, labyrinthine, helical, spiraling, crooked, or otherwise indirect, as is known in the art. The addition of the coating 178 to a device configured to restrict the flow of water may further increase the effectiveness of any such device. Furthermore, other embodiments may include applying the coating 178 to any surface or component (e.g., screens, filters, shrouds, etc.) contained within, leading into, or leading away from the flow control device 132.

Finally, the coating 178 may be used near or in conjunction with existing water sensitive media, such as a Relative Permeability Modifier (or "RPM"), as is known in the art. In one embodiment, the coating 178 may be located on a surface in proximity or combination with the water sensitive media to increase the effectiveness of the existing configuration. In other embodiments, expandable materials or a fluid-actuated choke may be used in combination with surfaces containing the coating 178.

Of course, different structural embodiments of hydrophilic materials may be used other than the examples given herein (e.g., different dimensions, porous or nonporous materials, different porosities, packs comprising sleeves, beads, blocks, coatings, passageways, tubes, etc., or any combination thereof). Various arrangements will have different effects on impedance of the flow of water and may be desired in various situations.

Those of ordinary skill in the art will recognize and appreciate that the invention is not limited by the certain example embodiments described hereinabove. Rather, many additions, deletions and modifications to the embodiments described herein may be made without departing from the scope of the invention, which is defined by the appended claims and their legal equivalents. In addition, features from one embodiment may be combined with features of another embodiment while still being encompassed within the scope of the disclosure.

What is claimed is:

1. A flow control device for selectively controlling fluid flow from a subterranean formation, comprising:

a first tubular body having an interior surface, an exterior surface, and at least one aperture comprising an inlet extending through the first tubular body between the exterior surface and the interior surface;

a second tubular body located within the first tubular body, the second tubular body having an interior surface, an exterior surface, and at least another aperture comprising an outlet extending through the second tubular body between the exterior surface and the interior surface;

an annular cavity defined by the interior surface of the first tubular body and the exterior surface of the second tubular body;

at least one flow path extending from the exterior surface and through the inlet of the first tubular body, longitudinally through the annular cavity, and to the interior surface through the outlet of the second tubular body; and a material disposed in communication with the at least one flow path, the material having a hydrophilic surface located and configured to contact formation fluids flowing along the at least one flow path, wherein at least a portion of the material is disposed within the annular cavity, the material having a composition enabling flow of hydrocarbons through the material while restricting the flow of water through the material while maintaining a constant flow area of the at least one flow path.

2. The flow control device of claim 1, wherein the first tubular body comprises at least one filter located exterior to the material, the at least one filter configured to filter particulates from the formation fluids.

3. The flow control device of claim 2, wherein the material disposed in communication with the at least one flow path comprises a plurality of particles disposed between the at least one filter and the second tubular body.

4. The flow control device of claim 3, wherein the plurality of particles comprises at least one of quartz sand, flint, agate, porous glass, and glass beads.

5. The flow control device of claim 1, wherein the material disposed in communication with the at least one flow path comprises a tubular sleeve.

6. The flow control device of claim 1, wherein the material disposed in communication with the at least one flow path comprises a coating applied to a surface of the material disposed in communication with the at least one flow path.

7. The flow control device of claim 6, wherein the surface of the material disposed in communication with the at least one flow path comprises at least one of a channel, tube, orifice, port, and opening.

8. The flow control device of claim 1, wherein the material having the hydrophilic surface is selected from a group consisting of silicon dioxide ($SiO_2$) and surface-modified silicon dioxide.

9. The flow control device of claim 1, wherein the material having the hydrophilic surface comprises at least one of titanium dioxide ($TiO_2$) doped composites and ceramic-based composites.

10. A method for making a flow control device to selectively control fluid flow from a subterranean formation, the method comprising:

providing a first tubular body having an interior surface, an exterior surface, and at least one aperture comprising an inlet extending through the first tubular body between the exterior surface and the interior surface;

providing a second tubular body located within the first tubular body, the second tubular body having an interior surface, an exterior surface, and at least another aperture comprising an outlet extending through the second tubular body between the exterior surface and the interior surface;

defining an annular cavity with the interior surface of the first tubular body and the exterior surface of the second tubular body;

defining at least one flow path extending from the exterior surface and through the inlet of the first tubular body, longitudinally through the annular cavity, and to the interior surface through the outlet of the second tubular body;

configuring a material having a hydrophilic surface to allow passage of hydrocarbons through the material while restricting the flow of water through the material while maintaining a constant flow area of the at least one flow path;

disposing the material having the hydrophilic surface in communication with the at least one flow path, at least a portion of the material being disposed within the annular cavity; and saturating at least a portion of the material with an initial amount of water.

11. The method of claim 10, further comprising positioning at least one of a filter, a mesh, and a permeable membrane exterior to the material.

12. The method of claim 10, wherein disposing the material in communication with the at least one flow path further comprises placing the material along the interior surface of the first tubular body.

13. A system for selectively controlling flow of a fluid from a subterranean formation, comprising:

at least one wellbore tubular;

a first tubular body positioned adjacent the at least one wellbore tubular, the first tubular body having an interior surface, an exterior surface, and at least one aperture comprising an inlet extending through the first tubular body between the exterior surface and the interior surface;

a second tubular body located within the first tubular body, the second tubular body having an interior surface, an exterior surface, and at least another aperture comprising an outlet extending through the second tubular body between the exterior surface and the interior surface;

an annular cavity defined by the interior surface of the first tubular body and the exterior surface of the second tubular body;

the first tubular body and the second tubular body defining at least one flow path extending through the inlet of the first tubular body, longitudinally through the annular cavity, and through the outlet of the second tubular body; and a material disposed in communication with the at least one flow path, the material comprising at least a hydrophilic surface located and configured to contact formation fluids flowing along the at least one flow path, at least a portion of the material being disposed within the annular cavity, wherein the material is configured to allow passage of oil-based formation fluids through the material while restricting the flow of water-based fluids through the material while maintaining a constant flow area of the at least one flow path.

14. The system of claim 13, wherein the first tubular body is located adjacent at least one perforation in the at least one wellbore tubular proximate at least one production zone prone to water production.

15. The system of claim 13, wherein the material disposed in communication with the at least one flow path comprises a plurality of discrete particles within a packet at least partially filling the at least one flow path.

16. The system of claim 13, wherein the material disposed in communication with the at least one flow path comprises a filter mesh at least partially obstructing the at least one flow path.

17. The system of claim 13, wherein the material disposed in communication with the at least one flow path comprises a coating applied to a surface of at least one flow control device having a tortuous pathway adjacent the at least one flow path.

18. The system of claim 13, wherein the material disposed in communication with the at least one flow path is positioned down a length of the first tubular body and further comprising a screen disposed exterior to the material along the length of the first tubular body.

* * * * *